United States Patent [19]

Bleich

[11] 4,207,789

[45] Jun. 17, 1980

[54] ANGLED CUTTER

[76] Inventor: Simon Bleich, 29, Gassergasse, A-1050 Vienna, Austria

[21] Appl. No.: 3,469

[22] Filed: Jan. 12, 1979

Related U.S. Application Data

[63] Continuation of Ser. No. 852,617, Nov. 18, 1977, abandoned.

[51] Int. Cl.[2] ..... B26D 1/06; B26D 7/26

[52] U.S. Cl. ..... 83/697; 83/620; 83/636; 83/640; 83/700

[58] Field of Search ..... 83/697, 620, 636, 640, 83/700

[56] References Cited

U.S. PATENT DOCUMENTS

| | | | |
|---|---|---|---|
| 3,148,575 | 9/1964 | Thyng | 83/700 |
| 3,233,494 | 2/1966 | Rupp | 83/640 |
| 3,483,779 | 12/1969 | Forthmann, Jr. | 83/620 X |

*Primary Examiner*—Frank T. Yost

*Attorney, Agent, or Firm*—Imirie and Smiley

[57] ABSTRACT

An angled cutter for cutting stacks of paper or the like comprises two blade assemblies, each of which is formed with a cutting edge portion which is tapered only on one side. Each blade assembly has a solid inside surface. The blade assemblies are self-supporting and detachably connected. At the joint between the two blade assemblies, each of the tapered surfaces is ground off slightly more toward the joint-defining edges and the cutting edge than along the remaining portion of the cutting edge so that a rake is formed at the corner.

1 Claim, 5 Drawing Figures

FIG. 1
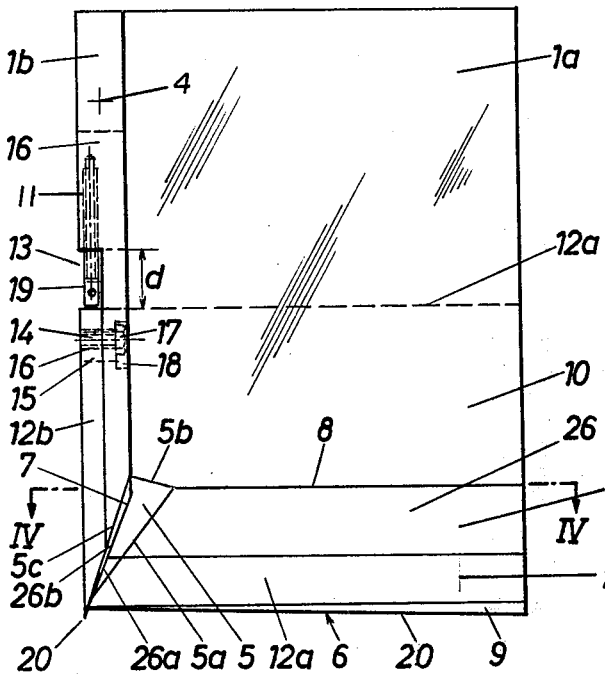
FIG. 2
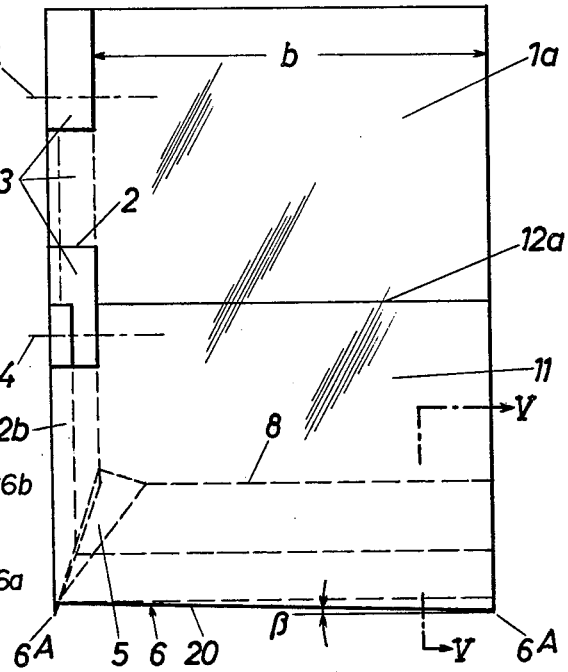
FIG. 3
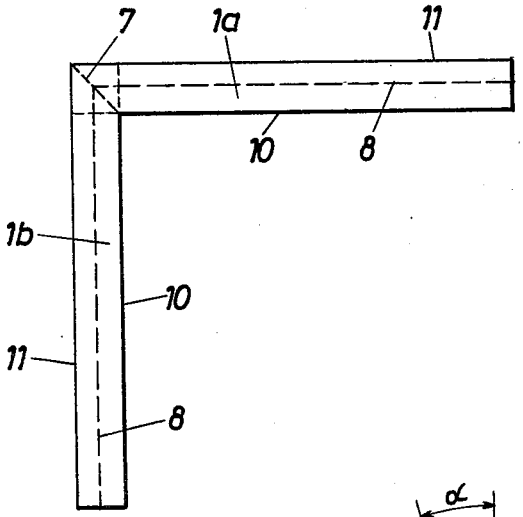
FIG. 4
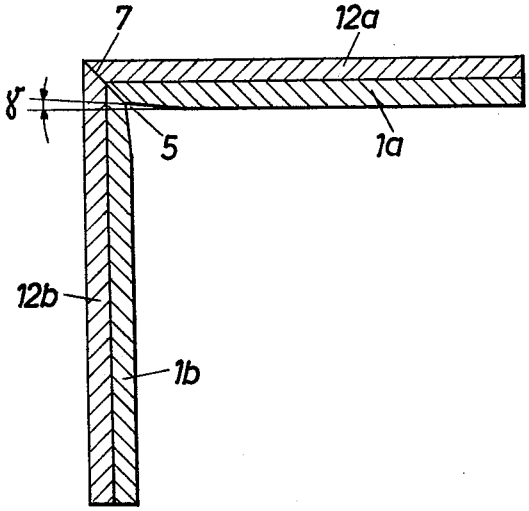
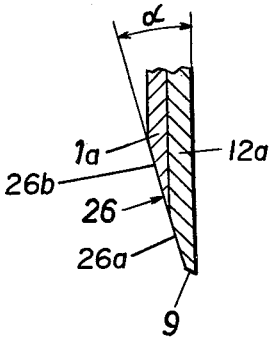
FIG. 5

ANGLED CUTTER

This is a continuation of application Ser. No. 852,617, filed Nov. 18, 1977, now abandoned.

SUMMARY OF THE INVENTION

An angled cutter for cutting stacks of paper comprises two detachably interconnected blade assemblies, each of which has a cutting edge which is defined by a tapering surface. Said tapering surfaces are ground to form a rake.

This invention relates to an angled cutter for cutting stacks of paper or the like, comprising two blades, each of which has a solid inside surface and is provided with a cutting edge portion which is tapered only on one side.

In known angled cutters of that kind, the blades are secured independently of each other to a carrier to be adjustable relative to each other, and the tapered surfaces of the cutting edge portions of the two blades are flat as far as to the joint. This has the disadvantage that the stack of paper being cut is contacted by both tapered surfaces at the corner which has been cut and may be deformed, particularly formed with creases, at said corner, especially if the paper is thin.

Unless the stack is adequately advanced during the penetration of the tapered surfaces of the blades, such creases may be formed even along the entire edge at which the stack is cut. Such inadequate advance is mainly due to the fact that the cutting edge which is upwardly inclined from the outer end toward the corner is defined by a facet of uniform width. The inclined cutting edge is used to ensure that the blade progressive penetrates the stack, beginning at the outer ends but the facet of uniform width hinders the advance of the stack as it is cut.

It is an object of the invention to eliminate the disadvantages of the known angled cutter. Another object of the invention is to provide at the corner of the angled cutter a rake where the corner that has been cut is not contacted by the tapered surface of the cutting edge portion so that said corner cannot be deformed.

It is also an object of the invention to provide means for advancing the stack from the tapered surfaces of the angled cutter as the latter penetrates the stack whereas the stack does not flow away.

Further details of the invention will be explained more fully with reference to the drawing, which shows an embodiment of the angled cutter. In the drawing FIG. 1 is a front elevation showing the angled cutter, FIG. 2 is a rear view thereof, FIG. 3 is a top plan view thereof, FIG. 4 is a sectional view taken on line IV—IV in FIG. 1 and FIG. 5 is a sectional view taken on line V—V in FIG. 2.

The angled cutter serves to cut stacks having a simple rectangular configuration and for this purpose comprises two identical blade holders 1*a*, 1*b*, which carry respective blades 12*a*, 12*b*. Each blade 12*a* or 12*b* is fitted into a mating recess 13 in the outside surface of the blade holder 1*a* or 1*b* and is held by a screw 14, which is vertically adjustable in a slot 15 and in threaded engagement with a threaded hole 16 of the blade. The outside surface of each blade is flush with the outside surface of the associated blade holder. The head 17 of the screw 14 is received by a recess 18 in the inside surface of the blade holder 1*a* or 1*b* and is vertically movable therein. A screw 19 is adjustably mounted in each blade holder and bears on the top face of the associated blade 12*a* or 12*b*. This screw serves to take up the cutting pressure and to determine the elevation d. Each blade 1*a* or 1*b* is fixed in the desired position in that the screw 14 is tightened. Each blade 1*a* or 1*b* can be re-ground as long as the screw 14 has a vertical clearance in the slot 15 or 18. Each blade holder 12*a* or 12*b* may be provided with a plurality of successive slots so that the screw 14 which has arrived at the lower end of one slot can be inserted into the next following slot.

The blade holders 1*a* and 1*b* are assembled to extend at right angles to each other. To facilitate the assembling, the blade holders have a groove 2 at one of the two edges to be joined and are provided at the other of said edges with a projection 3 mating said groove. The projection 3 of one blade holder 1*b* extends laterally into the groove 2 of the adjoining blade holder. The blade holders 1*a*, 1*b* are secured to each other by screws 4, which are inserted through lateral bores of the projections 3 and are in threaded engagement with tapped bores in the end wall of the groove 2.

Each cutting edge portion 6 has a ground surface 26 which tapers in wedge shape from the inside surface 10 to the outside surface 11. Each of said tapering surfaces 26 consists of a tapering surface portion 26*a* of the blade and a tapering surface portion 26*b* of the blade holder. The two tapered surface portions lie in a common plane. Only the tapered surface portion 26*a* of the blade is re-ground when this is required. Adjacent to the corner of the angled cutter, the lower edges 20 of the cutting edge portions 6 or tapered surface portions 26*a* are upwardly inclined at a small angle toward said corner so that the cutting edge portions 6 can progressively penetrate a stack of sheets, beginning at the outer ends $6^A$, even when the sheets consist of very thin paper. In a preferred embodiment, the angle $\alpha$ at the cutting edge is 20° and the angle $\beta$ between the cutting edge and the horizontal is 1 to 2 degrees. The wider the blade, the smaller is the angle $\beta$. The angle $\beta$ may be about 1° if the blade has a width b of 300 mm and may be about 2° if the blade has a width b of 150 mm. Adjacent to the corner, the tapered surface 26*b* of each blade holder is gound off to a slightly larger extent, e.g., at an angle $\gamma$ of 2 to 3 degrees. toward the joint-defining edge 7 and the lower edge 8 so that a rake 5 is ground which is defined by the edges 5*a*, 5*b*, 5*c* and the cutter cannot clamp the stack as it is cut because the cutter clears the corner of the stack which has been cut. To promote the advance, the outer marginal region of the cutting edge portion 6 or tapering surface 26*a* is ground off at an angle which increases from zero at the corner of the blades preferably to 2° so that a facet 9 is formed, which tapers to the corner of the blade and has a top edge which is horizontal, i.e., parallel to the ground edge 8.

The angle cutters embodying the invention distinguish by a high durability and service life and can be manufactured economically in a simple manner.

It will be understood that the two blade holders 1*a*, 1*b* may be assembled to include any desired angle. Although only stacks of paper have been referred to hereinbefore, the angled cutter according to the invention may be used also to cut cardboard or the like.

What is claimed is:

1. An angled cutter for cutting stacks of paper, comprising two flat blade holders, means detachably connecting said blade holders to each other to extend at an angle to each other, each of said blade holders having in the lower portion of its outside surface a recess, a flat blade vertically adjustably mounted and fixed in an adjusted position in each said recess, the lower end of said blade and the lower end of said blade holder jointly forming a planar tapered surface which extends from a cutting edge on the outside of the blade to the inside surface of the blade holder, said tapered surfaces of both blade holders and of the blades inserted therein being increasingly greater from the joint between said blade holders and between said blades to the ends of said blades remote from said joint, each said blade being increasingly ground off at its cutting edge from the corner between said blades so that a facet is formed which defines a cutting edge which is slightly upwardly inclined toward said corner.

* * * * *